US009286866B2

(12) United States Patent
Fugate et al.

(10) Patent No.: US 9,286,866 B2
(45) Date of Patent: Mar. 15, 2016

(54) DRUM AND METHOD FOR TUNING AND MAKING A DRUM

(71) Applicants: Brett Fugate, Brookfield, IL (US); Kevin Fugate, East Peoria, IL (US); Jerry Fugate, Washington, IL (US)

(72) Inventors: Brett Fugate, Brookfield, IL (US); Kevin Fugate, East Peoria, IL (US); Jerry Fugate, Washington, IL (US)

(73) Assignee: Fugate Instruments, Washington, IL (US)

( * ) Notice: Subject to any disclaimer, the term of this patent is extended or adjusted under 35 U.S.C. 154(b) by 292 days.

(21) Appl. No.: 13/687,992

(22) Filed: Nov. 28, 2012

(65) Prior Publication Data

US 2013/0139671 A1 Jun. 6, 2013

Related U.S. Application Data

(60) Provisional application No. 61/630,089, filed on Dec. 5, 2011.

(51) Int. Cl.
*G10D 13/02* (2006.01)

(52) U.S. Cl.
CPC ..... *G10D 13/021* (2013.01); *G10D 13/028* (2013.01); *Y10T 29/49574* (2015.01)

(58) Field of Classification Search
CPC ..... G10D 13/021; G10D 13/028; Y10T 29/49574
USPC ..... 84/411 R
See application file for complete search history.

(56) References Cited

U.S. PATENT DOCUMENTS

| | | | | |
|---|---|---|---|---|
| 2,036,363 | A * | 4/1936 | Schaefer | 52/245 |
| 4,522,006 | A | 6/1985 | Plikuhn | |
| 5,103,707 | A | 4/1992 | Hogue | |
| 5,301,591 | A | 4/1994 | Greenberg | |
| 6,417,432 | B1 | 7/2002 | Downing | |
| 7,446,250 | B1 | 11/2008 | Van der Meulen | |
| 7,960,632 | B2 * | 6/2011 | Izen et al. | 84/411 R |
| 8,853,514 | B2 * | 10/2014 | Cox, Jr. | 84/411 R |
| 2010/0300261 | A1 * | 12/2010 | Krishnamurthy | 84/413 |

* cited by examiner

*Primary Examiner* — Jianchun Qin
(74) *Attorney, Agent, or Firm* — James Faier; Martin Faier; Faier & Faier P.C.

(57) ABSTRACT

A drum having a vibratory member(s) tensioned over a plurality of tuned staves which acts as a sounding board and having staves which may be joined together with one or more flexible lines. The invention also includes a method of making such a drum and includes variations in the bearing edges of the tuned staves for such a drum.

14 Claims, 5 Drawing Sheets

DETAIL A
SEE FIG. 10
SCALE 2.000

SECTION 10-10

SECTION 9-9

DETAIL D
SEE FIG. 15
SCALE 1.250

SECTION 15-15

SECTION 14-14

DETAIL B
SEE FIG. 18
SCALE 1:250

DRUM AND METHOD FOR TUNING AND MAKING A DRUM

PRIORITY CLAIM

Priority is claimed under Provisional Patent Application Ser. No. 61/630,089, filed Dec. 5, 2011, for a DRUM AND METHOD FOR TUNING AND MAKING A DRUM.

BACKGROUND AND SUMMARY OF THE INVENTION

This invention relates to musical instruments and is more particularly related to a novel drum construction and the methods and processes for making and tuning a drum, as well as for constructing novel drum staves and manufacturing a novel drum. The invention includes specialized tuning, arranging, joining, and tensioning methods for drum manufacturing and for stave-construction drum shells that may utilize specialized tuning, joining, and tensioning methods. Novel staves, novel tensioning systems, and novel optional variations of the bearing edge provide different sounds and timbres are disclosed, which cannot be achieved with conventional prior art drums.

Thus this disclosure provides preferred embodiments of a drum that is tuned with conventional tuning instruments and tools, such as but not limited to a band saw, mill, lathe, sander, drill, strobe, oscilloscope, lights, lasers, trade secrets, and/or CNC machinery. The disclosure utilizes a plurality of tuned staves providing a profile for said staves, assembled with one or more tensioned flexible lines wherein the assembly comprises a tuned sounding board, resonating chamber, or drum shell that is mounted into a novel tensioning mechanism comprising tensioning rim(s), support rim(s), vibratory member(s) (commonly known as a head(s), drum head(s), and may in particular be referred to as batter and carry head(s) wherein one is struck or excited and the other resonates respectively), pluralities of tensioning rods, washers, threaded rods, nodal blocks, nuts, and optional variations in the bearing edge.

This novel type of stave construction drum comprising a tuned sounding board, resonating chamber, or drum shell allows it's bearing edges to vary from stave to stave and/or from opposed ends. The preferred embodiment of this invention may utilize the following shapes pertaining to the bearing edge: an angle, a radius, a flat, and/or being partially omitted. Thus any pattern or option of bearing edge shapes may be built into the novel array of tuned staves allowing for a variable bearing edge.

The flexible line(s) biases an array of adjacently positioned novel tuned staves which are apertured arranging said flexible line(s) through said aperture and allowing the plurality of tuned staves to take and hold the shape of a cylinder wherein said novel tuned staves extend from the inside to the outside of the drum. Said novel tuned staves are adapted to vibrate freely when excited and harbor the ability to move relative to one another enhancing the overall timbre, response, effectiveness, dynamics, and versatility of the drum. The preferred embodiment of this disclosure includes an assembled array of tuned staves comprising a tuned sounding board, resonating chamber, or drum shell biased by a flexible line that is suspended between vibratory members wherein said vibratory members are tensioned to the tuned drum shell on opposed ends with a novel tensioning mechanism which positions a plurality of tensioning rods in tensioning rims allowing for a predetermined sound when vibratory member is excited.

A plurality of tensioning rods are positioned through a plurality of washers and clearance holes in said tensioning rims and said plurality of tensioning rods are joined to a plurality of threaded rods which are held in position by one or more support rims. The plurality of said tensioning rods are torqued down tensioning the vibratory members onto the tuned drum shell. One or more support rims holds the plurality of threaded rods in position. In turn the plurality of threaded rods supports a plurality of nodal blocks wherein adjustable tensioning means flexibly secures said nodal blocks in a selected position. Said nodal blocks which when engaged fully may function as a tuning place holder allowing either vibratory member to be kept at the same relative tuning position to the novel tuned drum shell in the event that the vibratory members may need to be removed or changed. When said nodal blocks are fully or partially engaged and selectively positioned, they may serve as a way to change the timbre of the drum by changing the way that the tuned drum shell may vibrate or resonate through the accentuation or attenuation of frequencies tuned into said tuned staves. When said nodal blocks are fully engaged or fully disengaged, they may allow the tuned drum shell to mimic the timbre of a conventional drum shell with hardware attached to it or project the timbre of a completely free-floating drum shell respectively. When said nodal blocks are fully or partially engaged, they may act as a dampening mechanism. Said nodal blocks may be discreetly located along the length of a respective stave or staves and threaded rods and flexibly secured into selective positions by nuts.

The present invention provides a sounding board, resonating chamber, or drum shell construction wherein specific frequencies or pitches are achieved through the manipulation of the geometry and tonal characteristics of said sounding board, resonating chamber, or drum shell and particularly the staves comprising said sounding board, resonating chamber and/or drum shell. The tuning scheme of the disclosed invention permits fundamental pitches and/or overtones of the drum shell to be selectively manipulated helping to selectively define the sound or intonation desired within the physical limitations of the disclosed invention. Thus dissonance, consonance or any middle ground between those two extremes may be predetermined and set to a tuning scheme, orientation, or configuration of the plurality of tuned staves within the physical limits of the structure of the invention. Said tuned staves may be selectively arranged adjacently to one another freely joined together with a flexible line that provides a means for ascertaining one or more musical tones from exciting a vibratory member to in turn excite said staves according to said selected frequencies. The tuning of the staves may also serve to increase the volume on the inside of the drum assembly thereby maximizing the amount of displaced air upon excitation giving said tuned drum shell a wider dynamic range while maintaining traditional drum sizes.

Novelty also resides in the method of joining staves with a flexible line(s). Tension on the flexible line(s) may be selectively tensioned to a predetermined degree with a tool such as a torque wrench and the amount of tension may affect the overall timbre of the assembled drum. The flexible line(s) also give the instrument more durability than any stave construction shell in the prior art because if this novel shell is dropped it will not break apart as will conventional stave construction drums. Said flexible line(s) allows the current invention a novel flexibility that allows said tuned drum shell to expand when vibratory members are excited and this may eliminate the need for a relief hole found in virtually all-prior art drums. Said flexible line(s) may eliminate the necessity of any adhesive from the stave construction drum shell design.

The present invention provides three distinct and novel tensioning mechanisms. The tensioning systems of the plurality of tuned staves through the flexible line(s), the tensioning system of the vibratory member(s) to the tuned drum shell, and the optional tensioning system that can be applied through the activation of the nodal blocks. Working in concert these systems along with the novel tuned drum shell transcend any prior art and provide unprecedented aural and physical capabilities in a sounding board, resonating chamber, drum shell, or drum assembly. Thus the disclosed invention incorporates a series of systems into a musical body commonly known as a drum or a percussion instrument and it allows greater versatility in the function, tuning, dynamics, and timbre of the drum.

Relevant U.S. Patent Documents

| U.S. Patents | | |
|---|---|---|
| 4,522,006 | June 1985 | Pilkuhn |
| 5,103,707 | April 1992 | Hogue |
| 5,301,591 | April 1994 | Greenberg |
| 6,417,432 | July 2002 | Downing |
| 7,446,250 | November 2008 | Van der Meulen |

DESCRIPTION OF PRIOR ART

Pilkuhn '006 invented a drum made from glued blocks utilizing dowels for added support and stability to the structure of the drum. Pilkuhn's invention shows apertures wherein dowels are fitted perpendicular to the bearing edge and the glued blocks are assembled in a brick wall fashion. The current disclosed invention eliminates the need for adhesive when joining together a drum made from objects such as blocks or staves. Pilkuhn makes no disclosure of tuning the blocks and lacks any description of novel hardware used to manipulate timbre.

Hogue '707 discloses the tuning of sounding boards of various musical instruments (including drums) to a reference sound by utilizing a series of metal bars to achieve relative pitch control. Hogue does not disclose any harmonically controlled tuned drum shell assemblies utilizing the novel stave construction or joining together adjacent staves by one or more tensioned flexible lines. Nor does Hogue discuss the function of any tensioning mechanism as part of the novel achievement of drum timbre.

Greenberg '591 manipulates the geometry of the drum shell by using a tapered configuration which claims improved resonance, sensitivity, and harmonic timbre of the entire drum but does not suggest any novel staves or arrangement of the staves into a tuned drum shell with a flexible line.

Downing '432 utilizes a tensioning mechanism to achieve a type of freely resonating drum shell absent of piercing or physical attachments. Downing's structure applies an intermediate hoop that is secured by the tension of the tensioning rim at the top vibratory member (batter head). Downing does not utilize any drum shell tuning. While Downing claims that no object except the vibratory members come in contact with the drum shell, the applicant's disclosure allows optional physical attachments for greater versatility in timbre and permits novel piercing of the shell. The current invention relies on a support rim where a plurality of threaded rods are secured generally at some point away from the tensioning rim(s) and in between the ends of the threaded rods.

Van der Muelen '250 provides a stave construction drum shell whereby the adjacent staves are interlocked with a tongue in groove joint intended to produce a different timbre from conventional stave construction shells by limiting the amount of necessary adhesive and also adding some strength and rigidity to the stave construction drum shell, but there is no disclosure of tuning the staves, increased flexibility and durability, or providing the disclosed novel drum structure, systems, and/or mechanism(s).

DETAILED DESCRIPTION OF THE INVENTION

Figure 4:
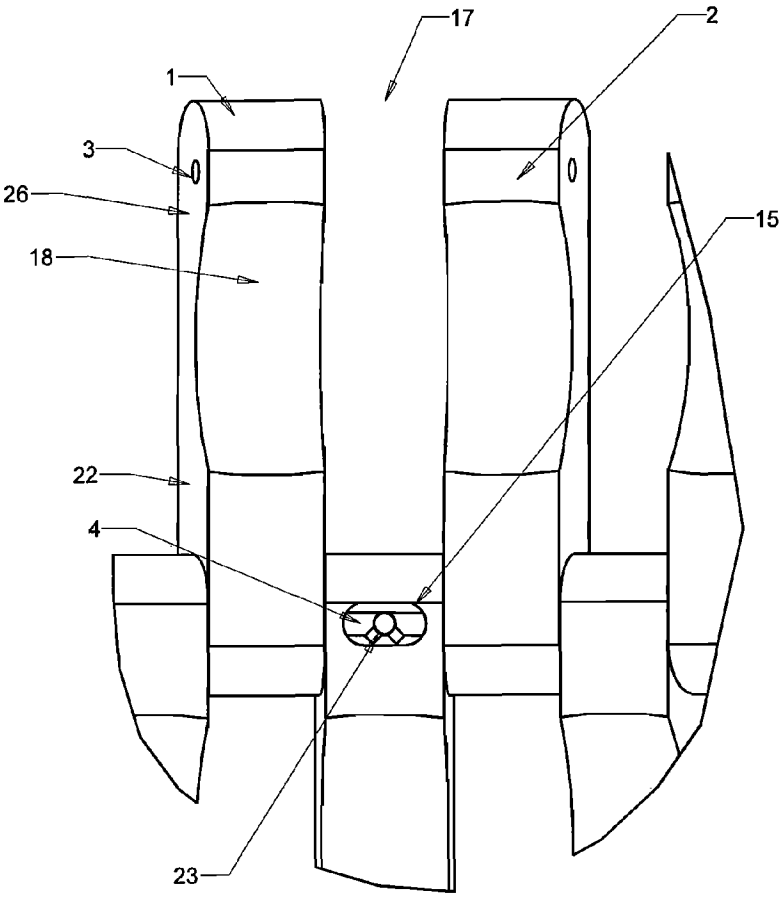
FIG. 4 is a partial view of assembled bearing edges of staves forming a partially omitted bearing edge.
Figure 3:
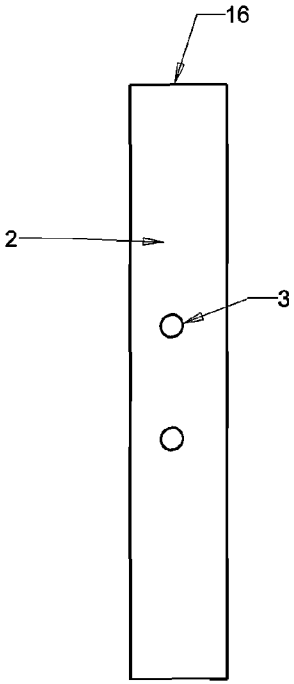
FIG. 3 is a side view of a second alternative bearing edge of a stave shaped as a flat.
Figure 2:
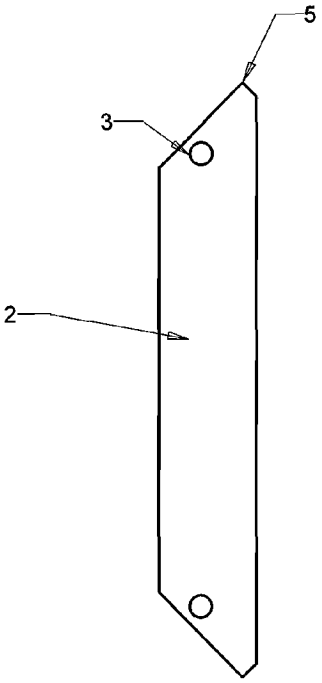
FIG. 2 is a side view of an alternate bearing edge of a stave shaped as an angle.
Figure 1:
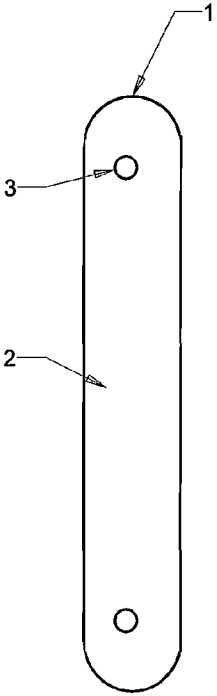
FIG. 1 is a side view of the bearing edge of a stave shaped as a radius.
Figure 7:
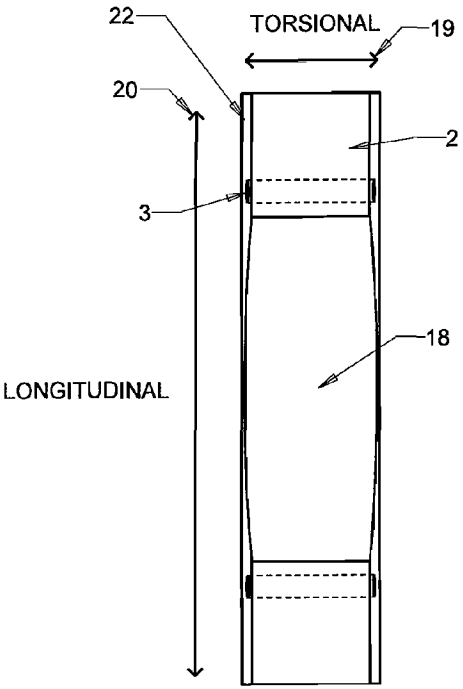
FIG. 7 is a view of the top or bottom of a stave with an arrow showing the relative direction of the torsional and longitudinal waves.
Figure 5:
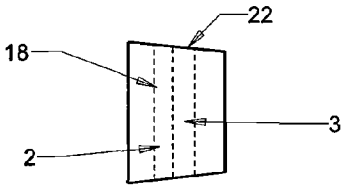
FIG. 5 is a view of the top or bottom of a stave showing an angle arrangement of a stave.

The preferred embodiments of the invention consist of a plurality of tuned blocks, boards, or staves 2 (see FIG. 1, 2, or 3). Said tuned staves 2 function to allow the sounding board, resonating chamber, or drum shell to vibrate evenly (in the case of consonance), unevenly (in the case of dissonance), or any middle ground between those two extremes across its entire body as set according to the predetermined tuning scheme. When air is displaced through the excitement of a vibratory member 12 (batter head) this evenness in shell tone translates into a better, truer sounding drum with the potential for increased resonance time, dynamics, and better projection of sound. Each individual stave 2 (depending on its size, material, geometry, and/or construction) will have a fundamental pitch and other overtones, harmonics, or partials, either occurring naturally, tuned into it, or occurring as a result of tuning. Other audible frequencies may result from the tuning of each stave 2 and the relationship of staves 2 relative to each other, relative to the tension of the vibratory member(s) 12, and/or relative to the tension on the flexible line(s) 4, and/or the placement of the nodal blocks 7.

Figure 12:
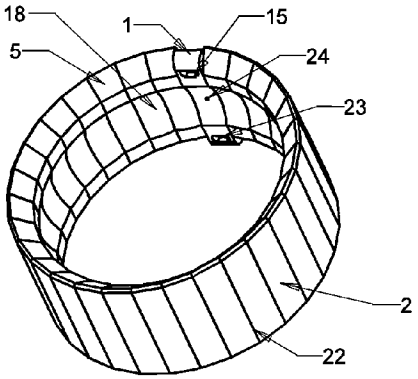
FIG. 12 is a perspective view of the drum shell shown in FIG. 8.
Figure 16:
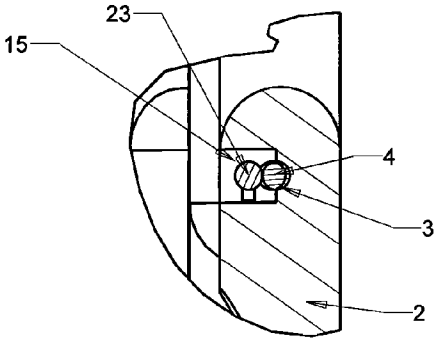
FIG. 16 is a detail view of the second embodiment showing connected staves taken as Detail D on FIG. 15.
Figure 13:
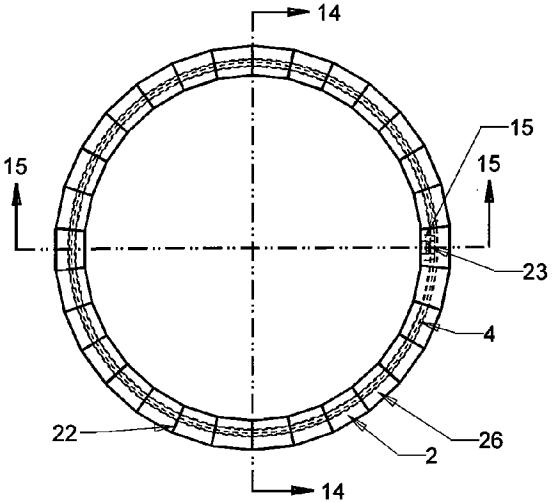
FIG. 13 is a top plan view of a second embodiment of the invention showing arranged staves assembled into a drum shell.
Figure 15:
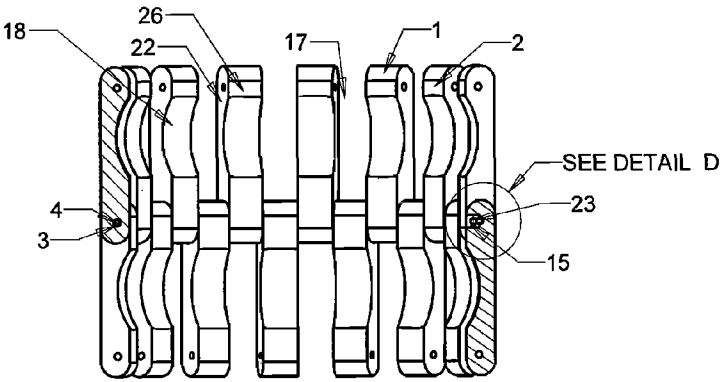
FIG. 15 is a sectional view of the second embodiment taken on line 15-15 of FIG. 13.
Figure 17:
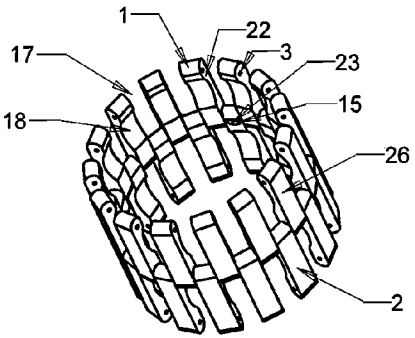
FIG. 17 is a perspective view of the drum shell shown in FIG. 13.

A multitude of tones may be selectively tuned into a particular stave 2 and compoundly into a plurality of staves dependent upon the assembling or biasing of said staves (see FIGS. 12 and 17). For instance, larger staves 2 will contain more and different audible overtones that may be selectively manipulated and smaller staves 2 will contain fewer audible overtones. The configuration of the tuned staves 2 into the tuned drum shell 26 constructions may also be derived from harmonic theory, music theory, species counterpoint, and/or melodic phrases and may lead to more possibilities of tonal configurations. For example, where each tuned stave 2 may be selectively tuned to a different note with different overtones; the different notes then may be oriented or biased into a harmonic or melodic structure such as a chord, harmony, or melody along the flexible line(s) 4 such as a simple triad like C, E, and G. If said tuned drum shell 26 is thought of on a coordinate plain, it may be a function of selectively arranging or biasing said staves 2 to achieve unique tonal qualities. Thus chords, scales, melodies, rests, and/or harmonies may be predetermined and arranged or biased into the configurations of the staves 2 before the flexible line(s) 4 commits them to a tuned drum shell 26.

Each stave 2 is adjacently oriented along the longitudinal wave 20 of the stave 2 and joined together by flexible line(s) 4 that are laced through a forced node or aperture 3. The flexible line(s) 4 serves as the novel method for joining the staves 2. The flexible line(s) 4 also serve as a tensioning system wherein varying degrees of tension may be applied to the tuned drum shell 26 and this can affect the overall timbre in relation to the tension applied to the vibratory member(s) 12 or any tension applied by the nodal blocks 7.

Figure 9:
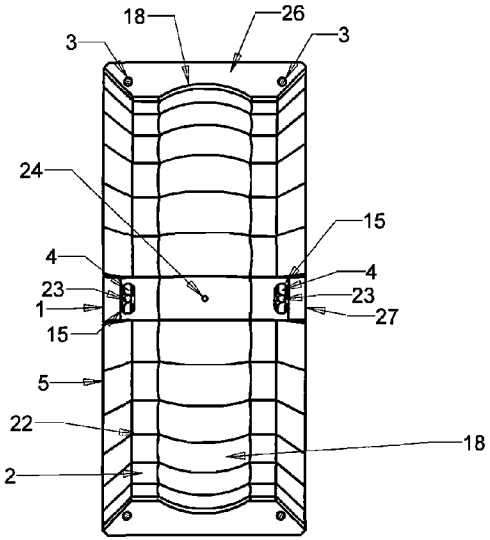
FIG. 9 is a sectional view of the first embodiment of the drum shell taken on line 9-9 of FIG. 8.
Figure 14:
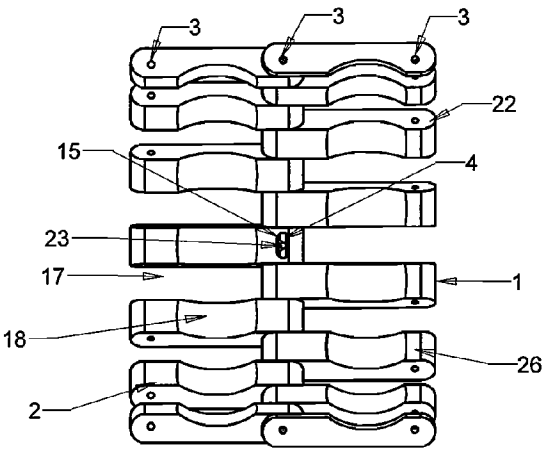
FIG. 14 is a sectional view of the second embodiment taken on line 14-14 of FIG. 13.

The preferred embodiment of the invention contains an origin 27 which is a stave that comprises a terminus for said flexible line(s) 4 (see FIGS. 9 and 14). An origin is a stave 2 with one or more recesses or profiles 15 exposing some length of the forced node(s) or aperture(s) 3 receiving the said terminus of said flexible line(s) 4 allowing said flexible line(s) 4 to be tensioned, tied, and to house a tensioned knot 23. The novelty of the joining of the staves 2 with a flexible line(s) 4 may allow the tuned drum shell 26 to expand upon excitement of the vibratory member(s) 12 depending on the amount of tension applied to the flexible line(s) 4 and the amount of air displaced upon exciting said vibratory member(s) 12. An optional relief hole 24 may be included in the tuned drum shell 26.

Figure 6:
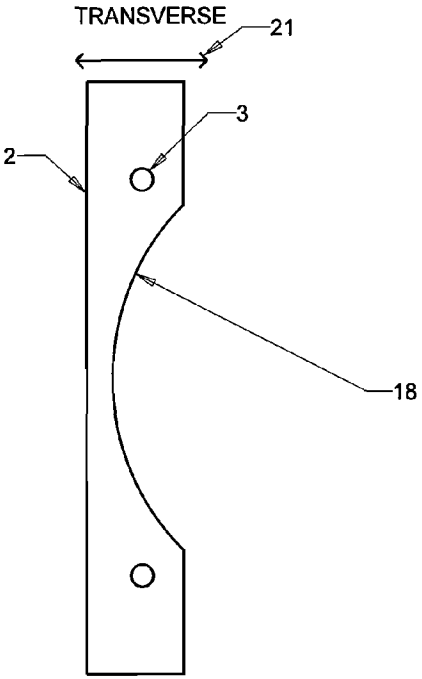
FIG. 6 is a view of the side of a stave with an arrow showing the relative directions of the transverse wave.
Figure 11:
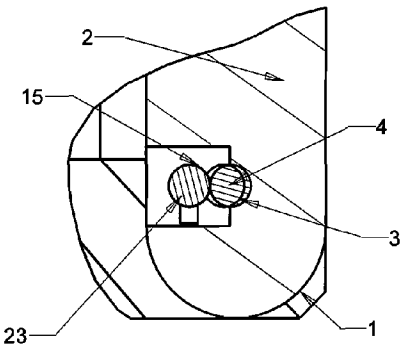
FIG. 11 is a detail view of the first embodiment showing connected staves taken as Detail A of FIG. 10.
Figure 8:
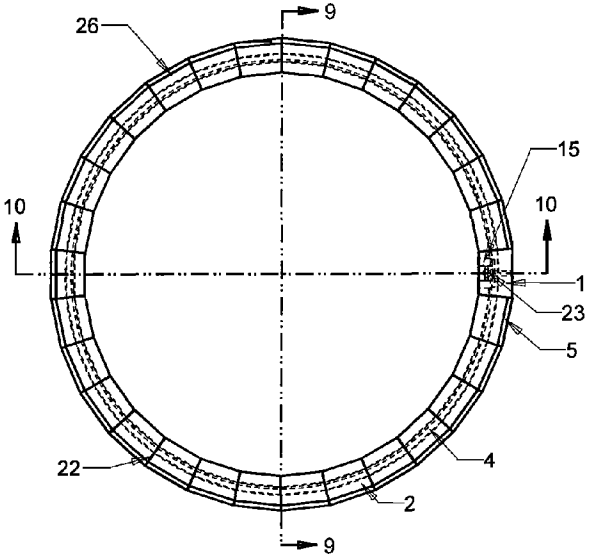
FIG. 8 is a top plan view of a first embodiment of the invention showing arranged staves assembled into a drum shell.
Figure 10:
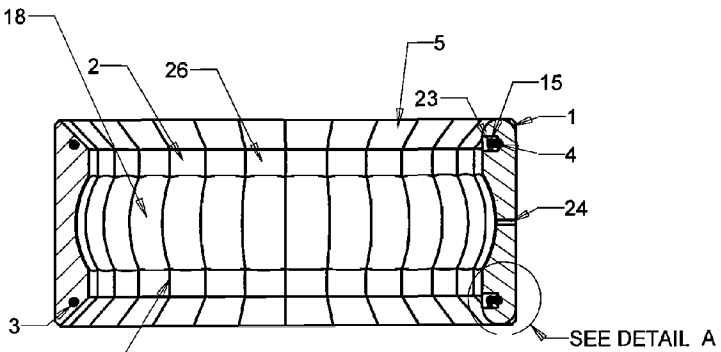
FIG. 10 is a sectional view of the first embodiment of the drum shell taken on line 10-10 of FIG. 8.

The forced node or aperture 3 refers to the hole manually put into the stave to host the flexible line(s) 4 and extend said flexible line(s) 4 through each stave 2. This structure permits selective effects in the transverse wave 21 (see FIG. 6) of the stave 2. Nodes occur naturally in each stave and this may be demonstrated with a Chladni test. Through tuning said stave 2 and drilling of said aperture(s) 3 the natural node may be forced into a particular orientation or location. It is desirable to find points of vibration to apply the forced node 3 to a particular stave 2 according to its length, initial pitch, destined pitch, and relationship to other staves 2 comprising said tuned drum shell 26.

Figure 20:
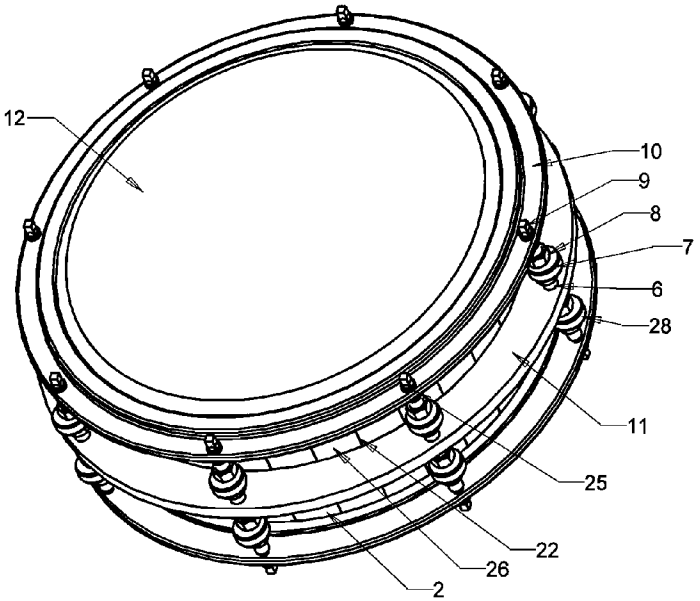
FIG. 20 is a perspective view of the third embodiment shown in FIG. 18.
Figure 21:
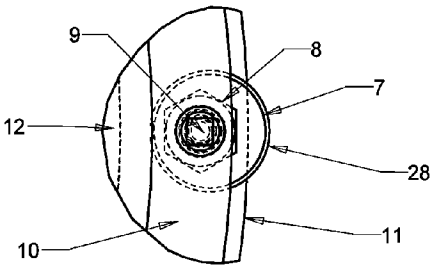
FIG. 21 is a detail view of part of the drum taken as Detail B of FIG. 18.
Figure 18:
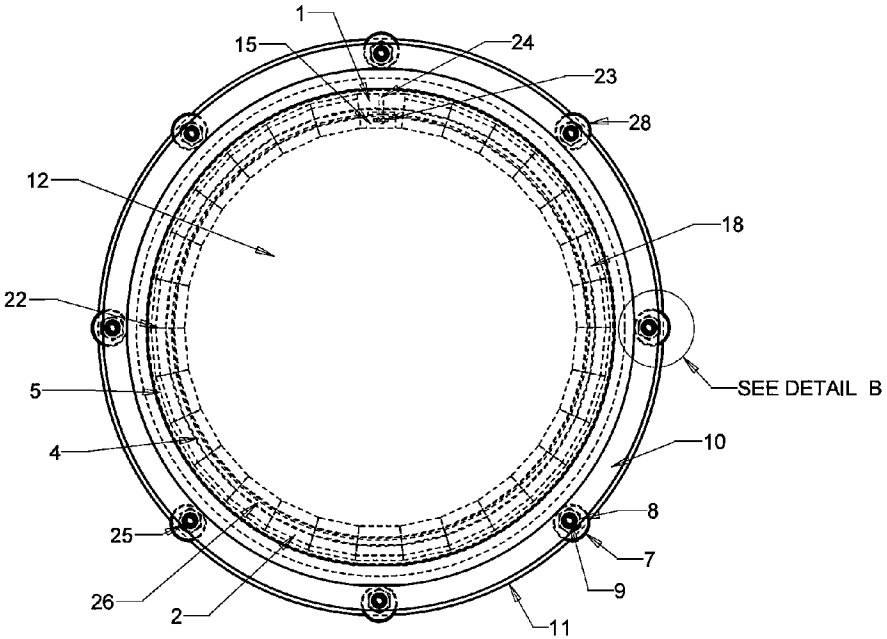
FIG. 18 is a top elevational view of a third embodiment of the invention, showing an assembled drum.
Figure 19:
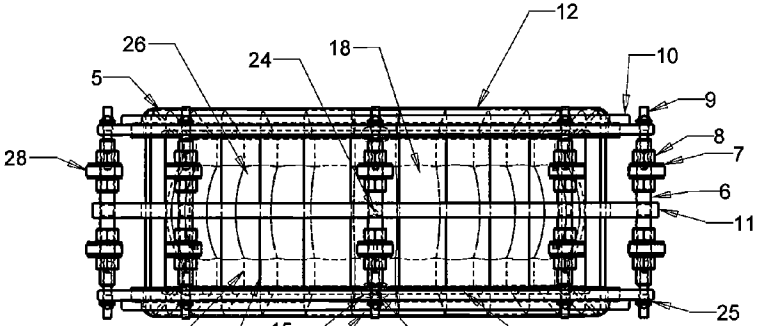
FIG. 19 is a side elevational view of the third embodiment of the invention.

Tensioning rims 10 and vibratory members 12 (batter and carry heads) are coupled with pluralities of tensioning rods 9 and washers 25 and serve to fix and tension the vibratory members 12 to said tuned drum shell 26. The vibratory members 12 are the part of the instrument that may be secured to the opposed ends of the tuned drum shell 26 and may be excited and the opposed vibratory member 12 may carry the displaced air and the vibration(s) of said tuned drum shell 26 which may increase the overall resonance and quality of sound of the drum (see FIG. 20). Said vibratory members 12 may be tuned to the same frequency as the tuned drum shell 26 and create a drum (see FIG. 20) with an amount of increased audible overtones, increased overall resonance, better more defined projection of sound, a wider range of dynamics, and a better sounding more defined instrument.

The plurality of threaded rods 6 are located with respect to the tensioning rims 10 by one or more support rims 11. Said plurality of threaded rods 6 may have threads on both the outside and inside of the rod. The outside threads of said threaded rods 6 may join with the support rim(s) 11 or said support rim(s) 11 may have clearance holes which in that case said threaded rods 6 may be secured to said support rim(s) 11 by nuts 8. Said nuts 8 may flexibly secure and position said nodal blocks 7 selectively on said threaded rods 6 along a discrete length determined by the overall length of said threaded rods 6. The inside threads of the threaded rods 6 receive the plurality of tensioning rods 9 which are positioned through clearance holes of the tensioning rims 10 and said tensioning rims 10 secure the vibratory members 12 to the tuned drum shell 26.

Nodal blocks 7 are made from any suitable material with a clearance hole wherein a threaded rod 6 may pass freely through. Said nodal blocks 7 may be fully activated, partially activated, or inactivated wherein different timbres and different mechanical applications may be achieved. Said nodal blocks 7 may be discretely located along the threaded rod 6 and said nodal blocks 7 may be selectively applied wholly or in part to change the vibratory pattern of the tuned drum shell 26. Said nodal blocks 7 may be wholly inactivated and the tuned drum shell 26 may freely vibrate. Said nodal blocks 7 may have some soft material 28 such as but not limited to felt or rubber along its perimeter to further absorb sound produced from said tuned drum shell 26 when activated fully or partially and may prevent damage that may occur to said nodal block 7 and/or tuned drum shell 26 as a result of interaction. Sound waves that move through said tuned drum shell 26 may be attenuated by the whole or partial activation of said nodal blocks 7. Said nodal blocks 7 may therefore be flexibly located discretely around the tuned drum shell 26 respective of said threaded rods 6 to allow for the manipulation of the sound wave moving through the staves 2 of the tuned drum shell 26 through the attenuation or dampening of the sound wave at that discrete locus. As a mechanism said nodal blocks 7 may be useful to emphasize, accentuate, or attenuate particular frequencies tuned into the drum (see FIG. 20). Furthermore, this novel drum (see FIG. 20) design allows the tuned drum shell 26 to be oriented in any 360 degree orientation and therefore it becomes possible to place said nodal blocks 7 on one individual stave 2 or more than one stave 2 simultaneously or to change the exact stave(s) where said nodal block 7 is situated.

Another novel purpose of the mechanism of said nodal blocks 7 is to lock the support rim(s) 11 and threaded rods 6 into place and allow the tensioning rods 9, washers 25, tensioning rims 10, and vibratory members 12 to be removed from the tuned drum shell 26 while maintaining the discrete locus of the threaded rods 6 and support rims 10 relative to a particular tensioning of the vibratory members 12 and tensioning rims 10 to the tuned drum shell 26. Said nodal blocks 7 would have to be activated to do this. This mechanism is therefore useful if a particular tension is desired and the vibratory member(s) 12 need to be changed. Thus said nodal blocks 7 provide another way that the timbre of this invention may be manipulated in the respect that a new or different vibratory member 12 may lead to a different timbre. Said nodal block 7 activation may also serve as another tensioning mechanism because activation may apply an inward force on the tuned drum shell 26 and this force may have the ability to change variables or features of said tuned drum shell 26 such as the profile of the stave 2 or the relative locus of the bearing edge 1, 5, 16, or 17.

Important to the timbre of the tuned drum shell 26 is the bearing edge(s) 1, 5, 16, or 17 (see FIG. 1, 2, 3, or 4). The bearing edge 1, 5, 16, or 17 is the point at which the tuned drum shell 26 contacts the vibratory member 12. In this invention the bearing edges 1, 5, 16, or 17 may be variable (see FIG. 12). A variable bearing edge 1, 5, 16, or 17 permits each stave 2 or combinations of staves 2 assembled into a tuned drum shell 26 may have a different finish, shape, or omittance of said bearing edge 1, 5, 16, or 17. Through the application of partially omitted bearing edges 17 the overall size of the tuned drum shell 26 may be changed or varied by connecting together multiple tuned drum shells 26 as in the case of a fork drum (see FIG. 17). A fork drum 26 is a tuned drum shell 26 but in the construction of said fork drum 26 (see FIG. 17) without any additional tuned drum shells 26 conjoined, each stave is adjacently and oppositely oriented to the next. Said fork drum 26 (see FIG. 17) in its singular form changes the timbre of the tuned drum shell 26 where the staves are analogous to tuning forks joined together. Said fork drum 26 (see FIG. 17) gives rise to a tonality wherein the sound of the stave is dominant as opposed to the displaced air in a closed type of tuned drum shell, resonating chamber, or sounding board 26 (see FIG. 12). Said fork drum 26 (see FIG. 17) may be built to mate parts of another tuned drum shell 26 and tensioned with a flexible line(s) 4 creating a modular drum through the joining of multiple tuned drum shells 26. The radius shaped bearing edge 1 (FIG. 1), the angle shaped bearing edge 5 (FIG. 2), the flat shaped bearing edge 16 (FIG. 3), and the partially omitted bearing edge 17 will create slightly different timbres from one another. Furthermore, the partially omitted bearing edge may be another reason why the relief hole 24 is optional. Variable bearing edges 1, 5, 16, or 17 (see FIGS. 9, 12) may produce various timbres across the staves 2 and across the vibratory member(s) 12 depending on how said staves 2 are oriented, configured and/or biased into a tuned drum shell 26.

The disclosed invention identified three tensioning systems and various tuned sounding boards, resonating chambers, or drum shells 26 that may be utilized in different applications independent of each other or one application dependent on each other. While preferred embodiments of the inventions have been shown and described in considerable detail, variations in the structure and function may be provided or modified without departing from the spirit, scope, or science of the invention.

The invention claimed is:

1. A drum shell comprising an array of staves arranged side by side in the form of a cylinder, said staves being tuned to a selected frequency, wherein flexible line means biases said staves together, wherein said staves when excited vibrate and cause said staves to move away from one another, and when not excited cause said staves to be brought together by said flexible line means arranged side by side together.

2. The drum shell recited in claim 1, wherein each stave has a bearing edge, and the bearing edges are of differing shapes.

3. The drum shell recited in claim 2, wherein a bearing edge is shaped as a radius.

4. The drum shell recited in claim 2, wherein a bearing edge is shaped as an angle.

5. The drum shell recited in claim 2, wherein a bearing edge is shaped as a flat.

6. The drum shell recited in claim 2, wherein a bearing edge is partially omitted.

7. The drum shell recited in claim 1 wherein one or more nodal blocks are located along one or more staves.

8. The drum shell recited in claim 7, wherein said line means flexibly secures said staves in a selected position.

9. The drum she recited in claim 7, wherein said adjustable tensioning means flexibly secures said blocks and staves in a selected position, wherein said adjustable tensioning means comprises a tensioning rim, a support rim, a vibratory member, a threaded rod, and a tensioning rod.

10. The drum shell recited in claim 1 wherein a stave has a profile.

11. The drum shell recited in claim 1 wherein a stave has a profile on the interior of said cylinder having a dimension midway its length less than the thickness of said stave.

12. The drum shell recited in claim 1, wherein said staves are varied in sizes.

13. The drum shell recited in claim 1, wherein said array of staves has an origin which comprises a terminus for said flexible line means.

14. The drum shell recited in claim 1, wherein each stave comprises a solid body from its interior to its exterior of said cylinder without cutouts opening said stave to the interior of said cylinder.

* * * * *